US007827662B2

(12) United States Patent
Dalseide

(10) Patent No.: US 7,827,662 B2
(45) Date of Patent: Nov. 9, 2010

(54) DEVICE OF A DESCALER HEAD

(75) Inventor: BjØrn Ove Dalseide, Bekkjarvik (NO)

(73) Assignee: Dalseide & Co., Bekkjarvik (NO)

( * ) Notice: Subject to any disclaimer, the term of this patent is extended or adjusted under 35 U.S.C. 154(b) by 996 days.

(21) Appl. No.: 10/566,141

(22) PCT Filed: Jul. 19, 2004

(86) PCT No.: PCT/NO2004/000220

§ 371 (c)(1),
(2), (4) Date: Jan. 27, 2006

(87) PCT Pub. No.: WO2005/009634

PCT Pub. Date: Feb. 3, 2005

(65) Prior Publication Data

US 2008/0066280 A1 Mar. 20, 2008

(30) Foreign Application Priority Data

Jul. 28, 2003 (NO) ..... 20033365

(51) Int. Cl.
*B21B 45/04* (2006.01)

(52) U.S. Cl. ..... 29/81.1; 29/81.05; 29/81.11

(58) Field of Classification Search ..... 29/81.01, 29/81.04, 81.05, 81.11, 81.03, 81.1
See application file for complete search history.

(56) References Cited

U.S. PATENT DOCUMENTS 1,694,018 A 12/1928 Mudge et al.
4,002,491 A 1/1977 Esparza
4,572,258 A * 2/1986 Mischel ..... 144/208.7
4,654,938 A * 4/1987 Dalseide ..... 29/81.05

FOREIGN PATENT DOCUMENTS

DE 562877 8/1932
GB 251533 5/1926

* cited by examiner

*Primary Examiner*—David P Bryant
*Assistant Examiner*—Bayan Salone
(74) *Attorney, Agent, or Firm*—Francis C. Hand; Carella, Byrne, et al.

(57) ABSTRACT

A device of a descaler head is described with circumferentially following and longitudinally following rows of descaler parts (22, 24, 26) where the descaler head comprises: a shaft (12) onto which are fed a number of holding elements for the descaler parts (22, 24, 26), said holding bodies are held together in axial direction with the help of adjustable gripping appliances on the carrier shaft, and each descaler part is connected to associated holding bodies via connecting means that are each in the form of a relatively short length of chain, piece of wire or similar flexible connecting means, at a distance from the rotational axis of the descaler head. The descaler head is characterized in that each holding body is formed by two mutually separated disc-formed elements(30, 32), with the descaler elements (22, 24, 26) being arranged held in between the plate elements of the holding body with mutual distance along their periphery, with each holding body (30, 32) being shaped with means to prevent mutual twisting in relation to the adjoining holding bodies.

10 Claims, 4 Drawing Sheets

DEVICE OF A DESCALER HEAD

The present invention relates to a device of a descaler head with circumferentially following and longitudinally following rows of descaler parts where the descaler head comprises: a shaft onto which are fed a number of holding elements for the descaling parts, said holding bodies are clamped together in the axial direction with the help of adjustable tightening appliances on the carrier shaft, and each descaler part is connected to an associated holding body via connecting means which are each in the form of a relatively short length of chain, piece of wire or similar flexible connecting means, at a distance from the axis of rotation of the descaler head.

More precisely, the invention relates to a descaler head that comprises a number of descaler units which side by side are non-rotatable fed onto a rotational shaft in the head.

The invention also relates to the construction of the above described holding element itself.

In particular, the present invention relates to how the descaler parts themselves, with their connecting means are fitted onto the shaft of the head of the descaler.

In NO patent 140.881 a descaler is shown that comprises a carriage-like apparatus which is arranged, via wheels or similar support bodies, to be moved along a surface that is to be worked on by the descaler. The descaler comprises a rotationally mounted descaler head with adjustable speed and which is equipped with the circumferentially following and longitudinally following rows of descaler parts. The descaler parts are secured to the descaler head at a considerable distance from its axis of rotation via associated short lengths of chain, pieces of wire or similar longitudinally flexible bodies.

Reference is also made to U.S. Pat. No. 4,654,938 (corresponds to Norwegian Patent Application NO 1983 0996) which concerns a similar descaler head.

The present invention aims to provide a new construction of a descaler head.

Furthermore, it is an aim of the invention to provide a descaler head comprising a number of descaler units which one by one is individually fed onto a rotational shaft.

Furthermore, it is an aim of the invention to provide a descaler head where the descaler units are formed or designed so that when the head rotates at a great speed, they are mutually stabilised so that they, relative to respective adjoining descaler unit(s), can not be rotationally displaced in relation to each other.

Furthermore, it is an aim of the invention to provide a descaler head where the descaler units, singly or altogether, can easily be replaced.

It is a further aim of the present invention to provide a new fastening device for the elements of a descaler unit that makes it easy to replace the chain parts when damages occur as a consequence of wear, breakage and the like.

It is a further aim of the present invention to provide a descaler head which by rotation will cover/strike/work on the whole of the surface that is to be descaled.

The device of the descaler units according to the invention is characterised in that each holding body is formed by two mutually separated plate-formed elements, with the descaler elements being arranged blocked in between the plate elements of the holding body with mutual distance along their periphery, with each holding body being shaped with means to prevent mutual rotation in relation to the adjoining holding bodies.

Further features of the inventive device are given in the dependent claims.

The invention shall now be explained in more detail with reference to the enclosed figures in which.

Figure 1:
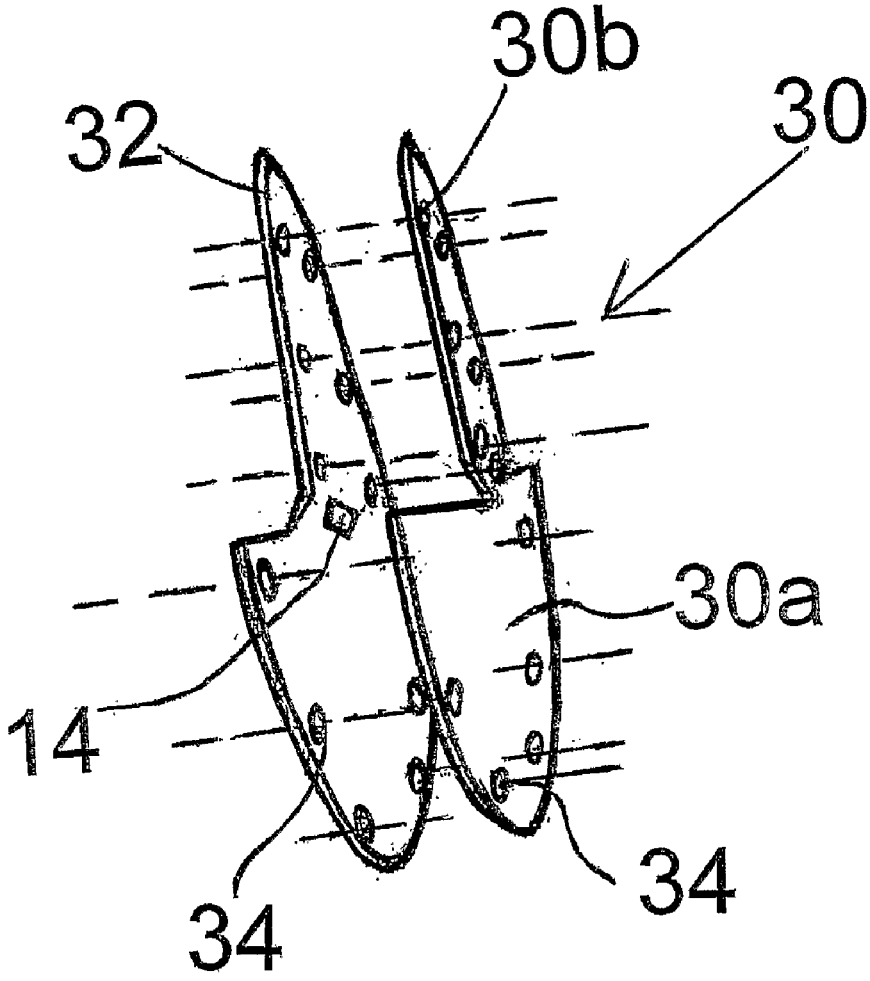
FIG. 1 shows a perspective section of the two disc-formed plates that form the starting point of a descaler element according to the invention.
Figure 2:
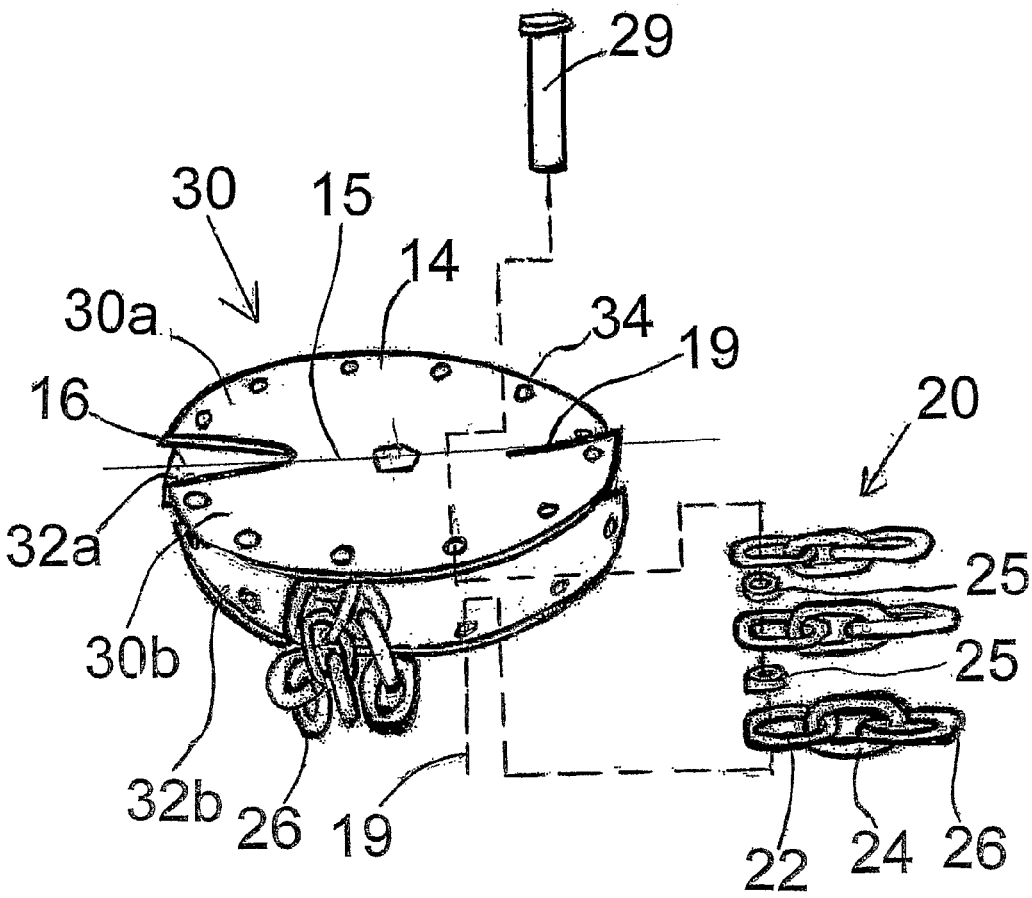
FIG. 2 shows a perspective section of a partially fully fitted descaler element according to the invention, with the figure also showing how the strike-giving chain elements are fitted.
Figure 3:
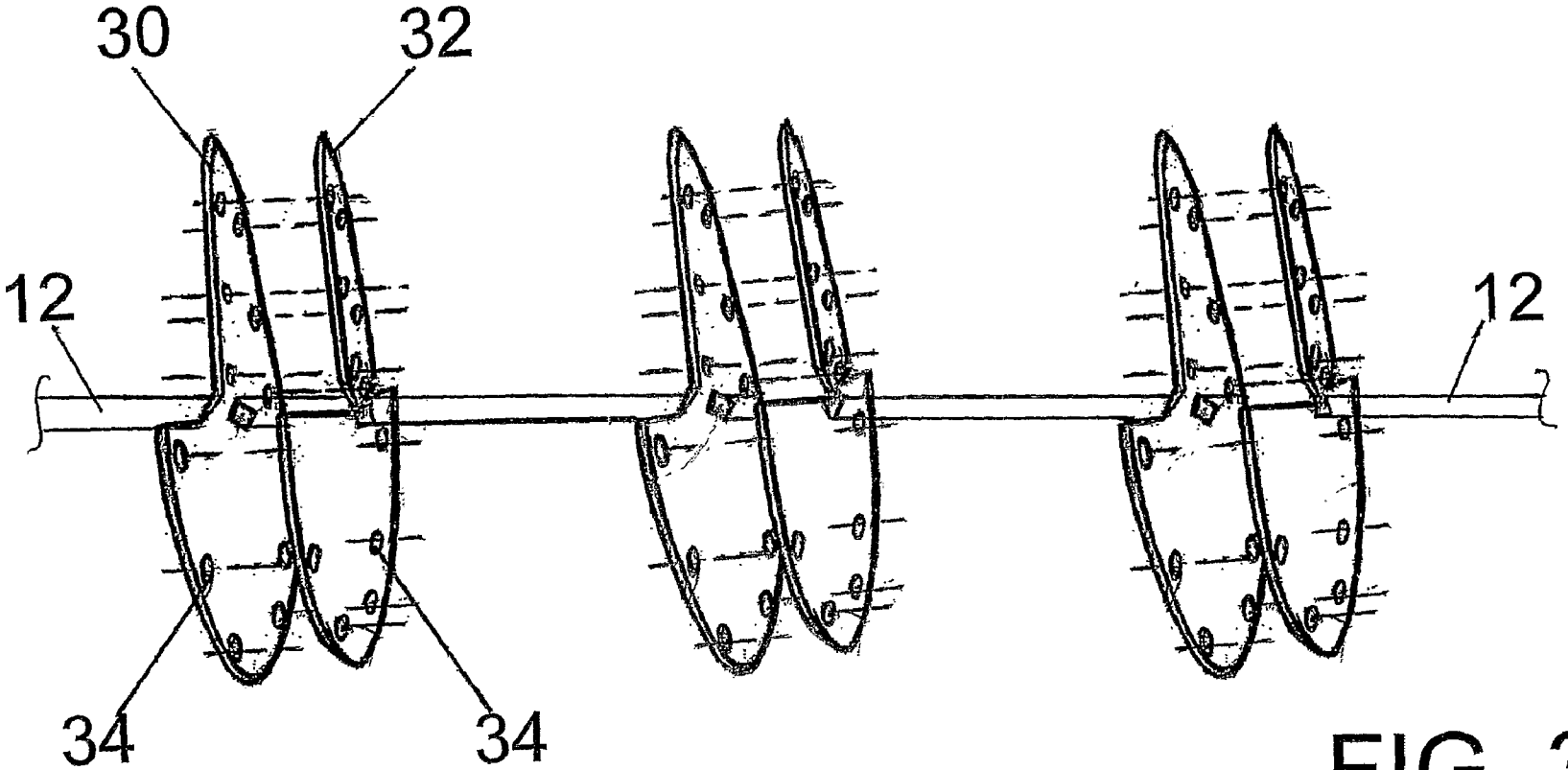
FIG. 3 shows schematically an expanded section of three pairs of disc-formed plates that are placed on the rotational shaft of a descaler head, i.e. without the strike-giving chain elements.
Figure 4:
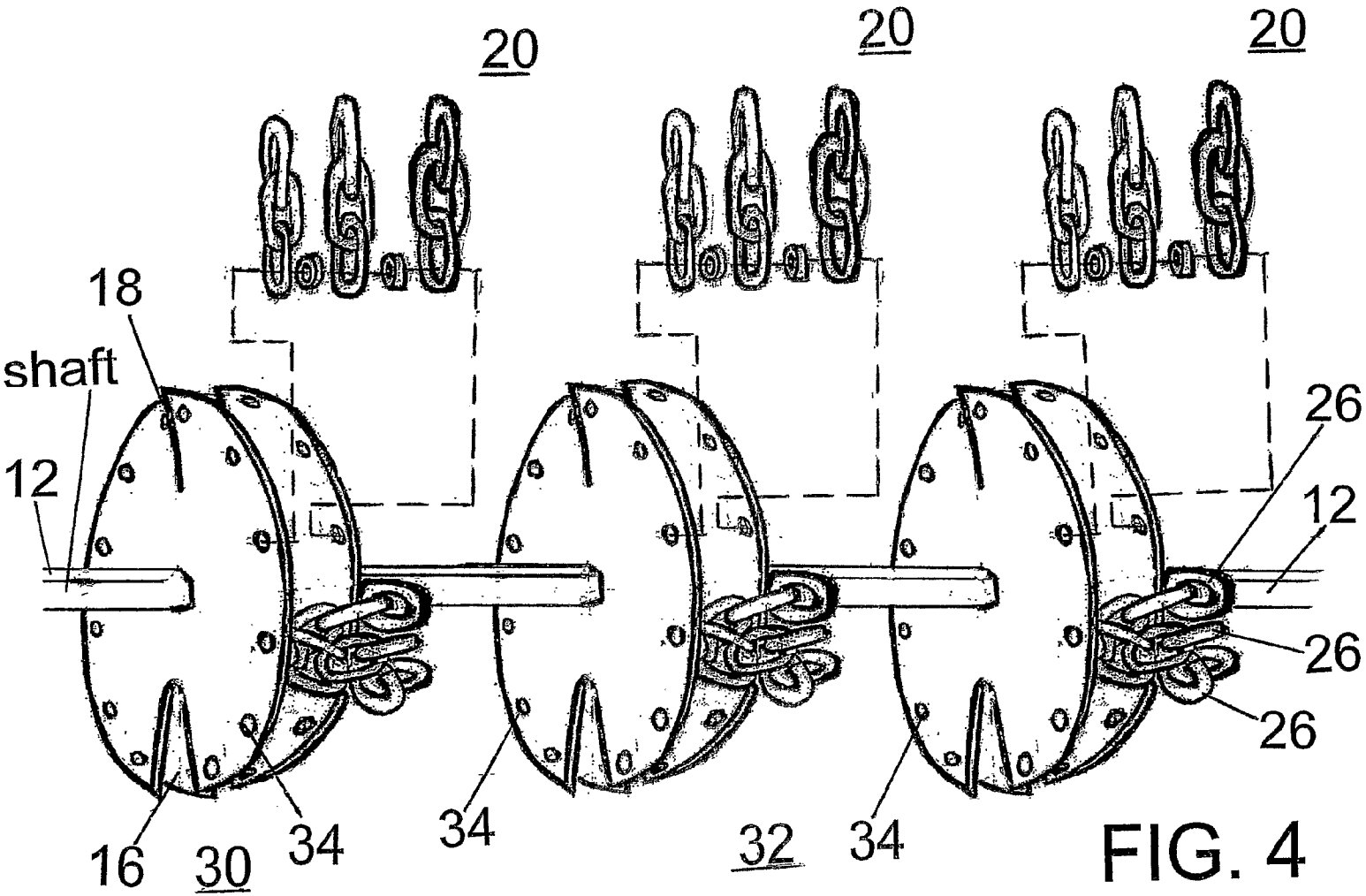

FIG. 4 shows a section which is analogous to FIG. 3 but shows in addition a set of chain links fitted between two adjoining plates in the element, and also how each chain is fitted, cf. FIG. 2. The figure indicates how a descaler head will appear.

In the following description reference is made to all the figures. The construction of the elements is shown up to the formation of a descaler head 10 that is mounted onto a rotational shaft 12 in the descaler instrument. The head is equipped with a number of circumferentially following and longitudinally following rows of descaler parts 20 in the following way. A number of pairs of disc-formed descaler elements 30,32 mutually spaced apart and with descaler units fitted, are fed onto the shaft 12 and fastened and secured against sliding axially on the shaft when the shaft/head rotates during operation of the descaler. The chain-formed descaler parts are peripherally fastened between the two disc-formed plate parts so that they extend peripherally outwards in the slit between the two plate parts. However, each plate disc 30,32, 34 is deformed so that the rows of descaler parts along the periphery form a fan shape/arch shape/spiral shape, or remain standing inclined, in relation to the peripheral rotation of the head. The deformation is made such that two plates fitted together, with all the fitted descaler chains, are symmetrical and will therefore rotate in balance and also that they will overlap each other. During the operation of the instrument along a surface that is to be descaled, the surface will be covered in its entirety over the whole breadth of the head, and without any formation of stripes of untreated surface (which will otherwise be very obvious, and which often necessitates that the same surface has to be treated twice to be completely processed). This becomes unnecessary with the present invention as the whole of the breadth is covered during a single operation across the surface.

An incision or groove 16 is cut diametrically in towards the centre of rotation 14 from the disc periphery of each plate disc 30,32, with the groove length constituting about half, or slightly over, the radius of the disc. Correspondingly, a groove 18 is cut from the diametrically opposite side, so that a straight line 15 along the two grooves 16,18 goes through the centre of the disc 14. Thereby, two disc halves 30A,30B and 32A,32B, respectively, are formed in each plate. Each disc half 30A,30B and 32A,32B, respectively, is thereafter deformed in that it is twisted about an axis 19 that runs transversely to the mentioned straight line, and which also runs through the centre of the disc 14. The two halves of each disc are mutually twisted in opposite directions about the axis 15. All the discs in a descaler head are twisted in the same way.

A number of holes 34 are drilled through the plate material along the periphery at a given distance from the outer edge in each disc 30,32, respectively. In addition, a polygonal central hole 14 is drilled out, that corresponds to the cross-section of the shaft 12 onto which the elements are to be fed.

Three sets of chain links are shown in FIGS. 2 and 4. They are comprised of inner, mid- and outer chain links 22,24,26, respectively, with the outer link 26 constituting the link that performs the descaling contact with the surface that is to be treated. Each chain is fastened to the respective peripheral part of the two disc-plates in the pair with the help of a bolt 29. Two and two chain links are separated at their anchorage on the bolt with the help of spacers 25.

Fitting of a Descaler Element

Two disc-plates 30 and 32, which have been drilled and deformed, are placed on top of each other so that the centre holes 14, associated slits 16 and 18, respectively, and also adjoining peripheral holes 19 are level with each other.

The disc-plates are placed mutually spaced apart and the inner end 22 of the three links are placed between the plates, level with the respective plate holes 34. The bolt 29 is inserted through the hole 34 in the one plate 30 and the three inner ends 22 of the links and also the spacers 25 and through the hole 34 in the other plate 32. When the bolt is guided all the way through, it can be riveted so that it is securely fastened with no possibility to come loose. However, the bolt can also be fastened with the help of any suitable method.

All chain links are mounted in this way around the periphery of the pair of disc-plates, and as shown in the figures, 12 chains in all are fitted around the circumference.

The fitting of the descaling element is now complete and the element is ready to be inserted on the rotational shaft 12 of a descaling head.

In addition, each descaling element (also denoted a cassette) is intended for on-time use. A worn or damaged element can easily be pulled off the shaft and be replaced by a new element, with the other elements still ready for use together with the new element.

Fitting of Descaling Elements to the Descaling Head

As the centre holes 14 in each element have the same cross section dimension as the shaft 12, the elements are easily fed onto the shaft. When the first element is fitted, the next is fed on with its slits 16,18 level with the corresponding slits 16,18 of the first fitted element. In turn, all the elements are inserted one by one in this way onto the shaft 12. Thereafter, the elements are secured in that the necessary nuts and washers are placed onto the shaft in the mounting seats of the descaling machine, so that the elements are kept tightly in place. The head is thereby ready for use.

As a consequence of the twisting of the disc halves 30*a*, 30*b*; 32*a*, 32*b* the contact surface between adjoining disc-plate parts forms a bevel angle (a non-right angle) with the axis of rotation 12. Furthermore, the slit parts will lie against each other, and partly engage with each other in that they are somewhat twisted in relation to each other. Any mutual relative twisting between two adjoining heads is thereby impossible.

The discs in the descaler units will thus form a fan, screw or spiral shaped continuous pattern from the one end of the rotational shaft on the head to the other end. One gets an overlapping in the circumference direction so that the whole of the surface that is to be descaled will be covered in one single operation of the instrument across the surface.

This feature contributes further to strengthen the rotational stability of the elements in relation to adjoining (on each side) elements. At the same time, the elements are easily pulled off the shaft and they can not get stuck to each other.

The invention claimed is:

1. A descaler head comprising a rotatable central support shaft;

at least one pair of disc-shaped plates mounted on said shaft for rotation therewith, each said plate having a pair of diametrically disposed deformed sections directed in opposite directions relative to each other, each said deformed section being twisted about an axis passing through a center of said resepective plate; and a plurality of descaler parts mounted peripherally of and between said pair of disc-shaped plates at a distance from said shaft, each said descaler part extending outwardly of said pair of disc-shaped plates with said descaler parts mounted on said deformed sections being longitudinally offset relative to the remainder of said descaler parts whereby upon rotation of said shaft said descaler parts descale overlapping sections on a surface to be descaled.

2. A descaler head as set forth in claim 1 wherein said descaler elements define a spiral shaped pattern about said shaft.

3. A descaler head as set forth in claim 1 each said plate has one of an incision and groove on diametrically opposite sides thereof to form two disc halves with the two disc halves being deformed in mutually opposite directions.

4. A descaler head as set forth in claim 3 wherein said one of an incision and groove is of a radial length equal to about half of a radius of said plate.

5. A descaler head as set forth in claim 1 wherein each descaler part includes a plurality of interconnected chain links with an innermost chain link being exchangeable fitted to said plates.

6. A descaler head comprising a rotatable central support shaft;

a plurality of pairs of disc-shaped plates mounted on said shaft in spaced apart axial relation for rotation therewith, each said plate having a pair of diametrically disposed deformed sections directed in opposite directions relative to each other, each said deformed section being twisted about an axis passing through a center of said resepective plate; and a plurality of descaler parts mounted peripherally of and between each said pair of disc-shaped plates at a distance from said shaft, each said descaler part extending outwardly of a respective said pair of disc-shaped plates with said descaler parts mounted on said deformed sections being longitudinally offset relative to the remainder of said descaler parts whereby upon rotation of said shaft said descaler parts descale overlapping sections on a surface to be descaled.

7. A descaler head as set forth in claim 6 wherein said descaler elements between each respective pair of plates define a spiral shaped pattern about said shaft.

8. A descaler head as set forth in claim 6 each said plate has one of an incision and groove on diametrically opposite sides thereof to form two disc halves with the two disc halves being deformed in mutually opposite directions.

9. A descaler head as set forth in claim 8 wherein said one of an incision and groove is of a radial length equal to about half of a radius of a respective plate.

10. A descaler head as set forth in claim 6 wherein each descaler part includes a plurality of interconnected chain links with an innermost chain link being exchangeable fitted to said plates.

* * * * *